US011898406B2

(12) United States Patent
Fosler et al.

(10) Patent No.: US 11,898,406 B2
(45) **Date of Patent: *Feb. 13, 2024**

(54) DRILLING TOOL CHANGER APPARATUS

(71) Applicant: Epiroc Drilling Solutions, LLC, Garland, TX (US)

(72) Inventors: Matthew Fosler, Wylie, TX (US); Samyuktha Pericharla, Bangalore (IN); Tyler Berens, Rockwall, TX (US)

(73) Assignee: Epiroc Drilling Solutions, LLC, Garland, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/899,012

(22) Filed: Aug. 30, 2022

(65) Prior Publication Data

US 2022/0412174 A1 Dec. 29, 2022

Related U.S. Application Data

(63) Continuation of application No. 17/161,880, filed on Jan. 29, 2021, now Pat. No. 11,466,522.

(51) Int. Cl.
*E21B 19/14* (2006.01)
*E21B 19/20* (2006.01)

(52) U.S. Cl.
CPC ..... *E21B 19/20* (2013.01); *E21B 19/146* (2013.01)

(58) Field of Classification Search
CPC ..... E21B 19/146; E21B 19/20
See application file for complete search history.

(56) References Cited

U.S. PATENT DOCUMENTS 3,976,149 A 8/1976 Granholm et al.
3,977,480 A 8/1976 Hilding
(Continued)

FOREIGN PATENT DOCUMENTS

CN 104005719 B 4/2016
WO 2008054302 A1 5/2008
(Continued)

OTHER PUBLICATIONS

PCT International Search Report for related PCT Application No. PCT/US2021/029105, dated Oct. 19, 2021, 4 pages.
(Continued)

*Primary Examiner* — Matthew R Buck
(74) *Attorney, Agent, or Firm* — Harper & Bates LLP; Shannon W. Bates

(57) ABSTRACT

An apparatus for changing a drilling tool for a drilling rig is described, where the drilling rig comprises a drill tower supporting a drill pipe. The apparatus for changing a drilling tool has a drilling tool changer assembly moveable between a storage position and an exchange position, and the drilling tool changer assembly supports a rotatable carousel assembly. The rotatable carousel assembly is capable of being removed from the drilling tool changer assembly and capable of replacement on the drilling tool changer in the same angular position with respect to the drill pipe as when removed. The rotatable carousel assembly has a plurality of bit adaptors for holding drilling tools and is selectively rotatable to bring a selected drilling tool into coaxial alignment with the drill pipe when the drilling tool changer assembly supporting the rotatable carousel assembly is moved into the exchange position.

20 Claims, 15 Drawing Sheets

(56) References Cited

U.S. PATENT DOCUMENTS

| | | | | |
|---|---|---|---|---|
| 6,457,526 | B1 * | 10/2002 | Dailey | E21B 21/001 166/356 |
| 7,886,846 | B2 | 2/2011 | Pires | |
| 8,342,236 | B2 * | 1/2013 | Bienfang | E21B 19/18 166/77.51 |
| 9,523,269 | B2 | 12/2016 | Hoult et al. | |
| 9,644,436 | B2 | 5/2017 | Hoult et al. | |
| 10,202,812 | B2 | 2/2019 | Gaska | |
| 11,220,872 | B2 * | 1/2022 | Diekmann | E21B 19/146 |
| 11,466,522 | B2 * | 10/2022 | Fosler | E21B 19/20 |
| 2010/0071958 | A1 | 3/2010 | Bienfang et al. | |
| 2014/0083774 | A1 * | 3/2014 | Hoult | E21B 17/00 175/52 |
| 2014/0338973 | A1 * | 11/2014 | Taylor | E21B 19/146 175/24 |
| 2018/0291696 | A1 * | 10/2018 | Amerson | E21B 19/18 |
| 2020/0217153 | A1 | 7/2020 | Gaska et al. | |
| 2022/0018196 | A1 * | 1/2022 | Gregg | B63G 8/001 |

FOREIGN PATENT DOCUMENTS

| | | | | |
|---|---|---|---|---|
| WO | 2009156574 | A1 | 12/2009 | |
| WO | 2009156575 | A1 | 12/2009 | |
| WO | 2018191280 | A1 | 10/2018 | |
| WO | 2019226096 | A1 | 11/2019 | |
| WO | WO-2019226096 | A1 * | 11/2019 | E21B 1/00 |

OTHER PUBLICATIONS

PCT Written Opinion of the International Search Authority for related PCT Application No. PCT/US2021/029105, dated Oct. 19, 2021, 4 pages.

English Translation (Abstract, Description and Claims) of CN 104005719 B obtained from https://worldwide.espacenet.com/ on Aug. 30, 2022, 5 pages.

* cited by examiner

DRILLING TOOL CHANGER APPARATUS

CROSS-REFERENCE TO RELATED APPLICATIONS

This application is a continuation of U.S. Non-Provisional patent application Ser. No. 17/161,880 filed Jan. 29, 2021 and entitled "Drilling Tool Changer Apparatus", which is incorporated herein by reference for all purposes.

TECHNICAL FIELD

This disclosure relates to drilling systems and more particularly to a drilling tool changer apparatus for use in applications such as mining, blast-hole drilling and other down-hole drilling applications.

BACKGROUND

This background section provides a context to the invention recited in the claims. The description here may include concepts that could be pursued, but are not necessarily ones that have been previously conceived or pursued. Therefore, unless otherwise indicated, what is described in this section is not prior art to the description and claims in this application and is not admitted to be prior art by inclusion in this section.

Drilling systems generally have a vertical drill tower, or mast, constructed from structural members such as steel beams and reinforcing supports. The drill tower is often coupled to a mobile platform, usually self-propelled, for positioning the drill tower in a desired location to conduct a drilling operation. The drill tower is often equipped with a drill magazine or holder of some sort, which is adapted to support a drill string formed from a combination of drill extenders, usually called drill rods or drill pipes. The drill magazine is used to selectively add the drill pipes to the drill string for drilling a hole having a desired depth. The drill magazine is intended to allow a drilling operation to progress into the drill hole by making readily available a continuous string of drill pipes as needed for advancing a drilling tool into a drill hole.

The lowermost drill pipe in the drill string is configured to receive a drilling tool at its lower end to conduct the drilling operation. The drilling tool is usually a drill bit or a down-hole hammer tool, but could be a sub with a drilling tool attached. (In this disclosure, the term "drill bit" may be used interchangeably for the general term "drilling tool", and the term "drill pipe" may be used interchangeably for the term "drill string", unless the context requires otherwise.) After a certain amount of usage in the drilling operation it is often desirable or necessary to remove and replace the drilling tool due to accumulated wear of an in-service drill bit, or the need to change between a drill bit and a hammering tool (or vice versa), etc. In order to minimize downtime in the drilling operation due to change-out of drilling tools, mechanisms may be provided to facilitate removing one drilling tool from the end of the drilling string and replacing it with another drilling tool from a storage or supply location.

What is needed is a replaceable magazine or carousel for drilling tools that does not require a large amount of space to accommodate swinging of an arm for the magazine, or for rotation of the magazine, which magazine can accommodate selecting drilling tools other than in a linear order, and which is readily adaptable for use in an automated or semi-automated manner to improve access for changing drilling tools, to minimize downtime during change-outs and to minimize the number of personnel required at the drilling rig.

SUMMARY

In accordance with one embodiment, an apparatus for changing a drilling tool for a drilling rig is described, where the drilling rig comprises a drill tower supporting a drill pipe. The apparatus for changing a drilling tool comprises a drilling tool changer assembly moveable between a storage position and an exchange position; where the drilling tool changer assembly supports a rotatable carousel assembly. The rotatable carousel assembly is capable of being removed from the drilling tool changer assembly and capable of replacement on the drilling tool changer in the same angular position with respect to the drill pipe as when removed. The rotatable carousel assembly has a plurality of bit adaptors for holding drilling tools and is selectively rotatable to bring a selected drilling tool into coaxial alignment with the drill pipe when the drilling tool changer assembly supporting the rotatable carousel assembly is moved into the exchange position. This Summary is provided to introduce a selection of concepts in a simplified form that are further described below in the Detailed Description. This Summary is not intended to identify key features or essential features of the claimed subject matter, nor is this Summary intended to be used to limit the scope of the claimed subject matter.

BRIEF DESCRIPTION OF THE DRAWINGS

Non-limiting embodiments of the present disclosure are described by way of example in the following drawings, which are schematic and are not intended to be drawn to scale:

FIG. 9 comprises perspective views of an embodiment of the carousel of the drilling tool changer assembly.

FIG. 12 comprises views of the rotatable carousel of the drilling tool changer assembly, where

FIG. 13 comprises perspective views of bit adaptors.

FIG. 14 comprises perspective views of an embodiment of the bit adaptors for the drilling tool changer. FIG. 14B shows a typical bit adaptor.

DETAILED DESCRIPTION

Figure 1:
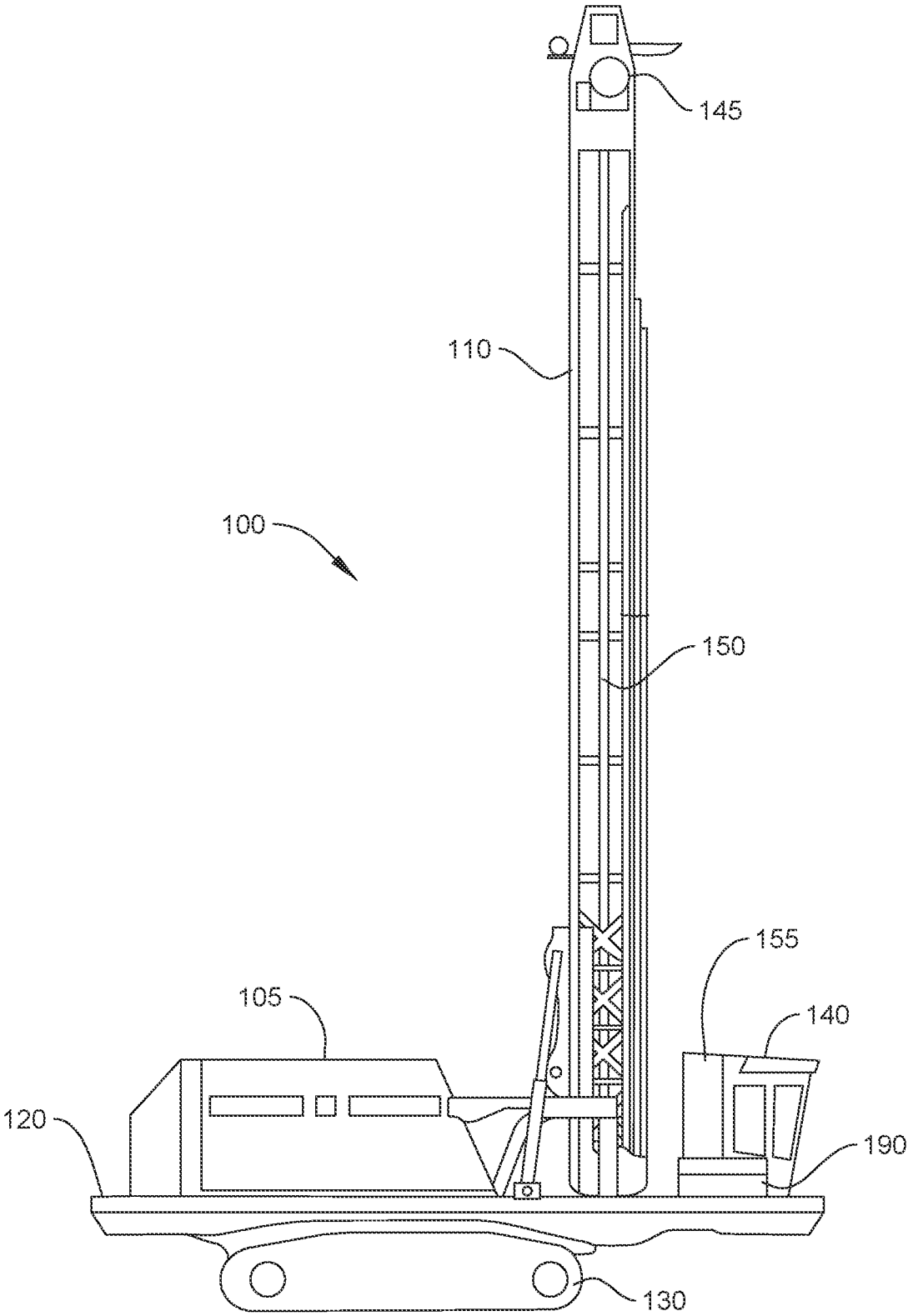
FIG. 1 shows a side view of an embodiment of a typical drilling machine having a tower capable of tilting, where the tower is raised to a vertical position.

FIG. 1 shows a side view of a typical mobile drilling machine 100. The drilling machine has a tower 110, a platform 120 supporting the tower 110, and typically tracks 130 or wheels for propelling the drilling machine over ground. FIG. 1 also shows an operator's cab 140 situated on the platform 120. The term "cab" in this disclosure refers to either a housing for an operator or a workstation location on the platform 120, which may or may not be occupied by an operator; the latter would be the case in autonomous machines. FIG. 1 shows the typical engine compartment or "power pack" 105, and mechanical accessories of a drilling machine 100. The tower 110 will also carry a drill string 150 extending through the tower 110, and a rotary head 145, being typically a hydraulic or electric motor for rotating the drill string 150. The drill string 150 is terminated at its lower end by a removable bit or drilling tool 215. In general, the tower 110 is pivotably moveable so that its tilt allows operations for the change-out of drilling tools 215. The drill string 150 and its components will be discussed in more detail below. The reader should note that the improvements disclosed here could be embodied in a fixed drilling machine as well as the mobile machine illustrated, and the claims cover both embodiments.

Figure 2:
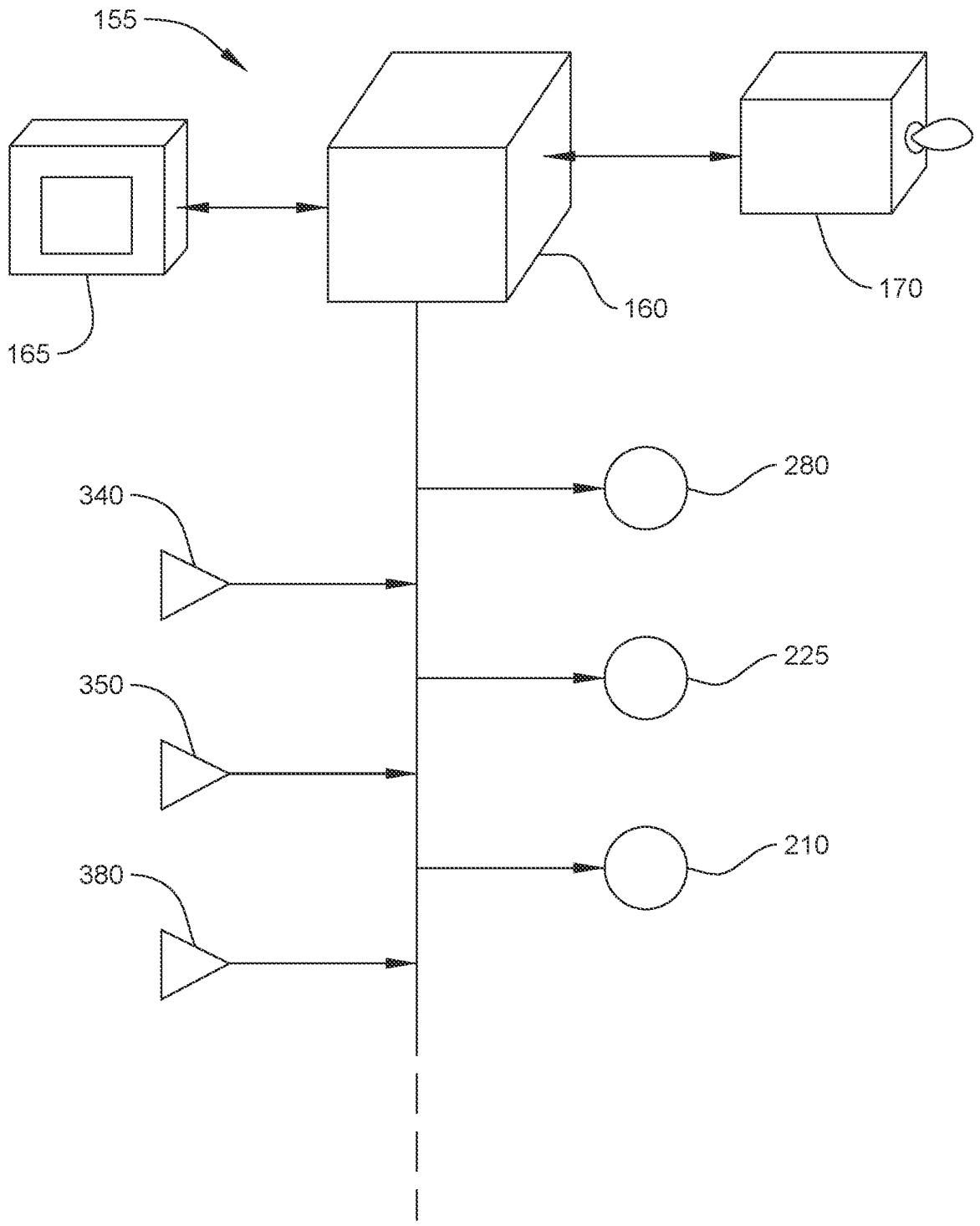
FIG. 2 shows schematically a general control system of the drilling machine, where a computer and peripherals are connected to operate the disclosed drilling tool changer apparatus.

The drilling machine 100 further includes a control system 155, which is operatively coupled to the power pack 105. The associated implements operatively connected to the power pack 105 and the control system 155 are described in more detail below and suggested only schematically in FIG. 1. FIG. 2 shows schematically the control system 155 operatively associated with the example drilling machine which here includes the disclosed drilling tool changer apparatus. The control system 155 comprises generally a computer 160 that is typically a programmable digital computer, further comprising a read-only memory, a non-transitory computer readable storage medium for storing instructions executable by a processor (such as a random-access memory), a central-processing unit or processor, and a hard drive or flash memory or the like for further storage of programs and data, as well as input and output ports. FIG. 2 shows the example control system 155 operatively connecting the computer 160 to a visual display 165 for an operator, and a control input interface 170, such as a joystick, or touch screen, or both. In this disclosure, the term "computer" may be used broadly to refer to both a programmable digital computer as just described, the software executed by the computer, and relevant peripheral devices connected to a computer, as well as networks of computers. One industrial example of a computer 160 suitable for controlling the operations of actuators in a tracked vehicle is the Rig Control System (RCS) provided by Epiroc Drilling Solutions, LLC. The computer 160 connects by means of a bus 115, which may be a wired or wireless network, to the various sensors and actuators shown in FIG. 2 (and in some embodiments, others).

The control system 155 includes one or more control inputs which can be adjusted by the operator in the operator's cab 140. These may include one or more input controls for controlling the operation of the tower 110, including its tilt angle, and also the operations of the drilling tool changer assembly 190, described below, which is a component of the drilling tool changer apparatus.

Figure 3:
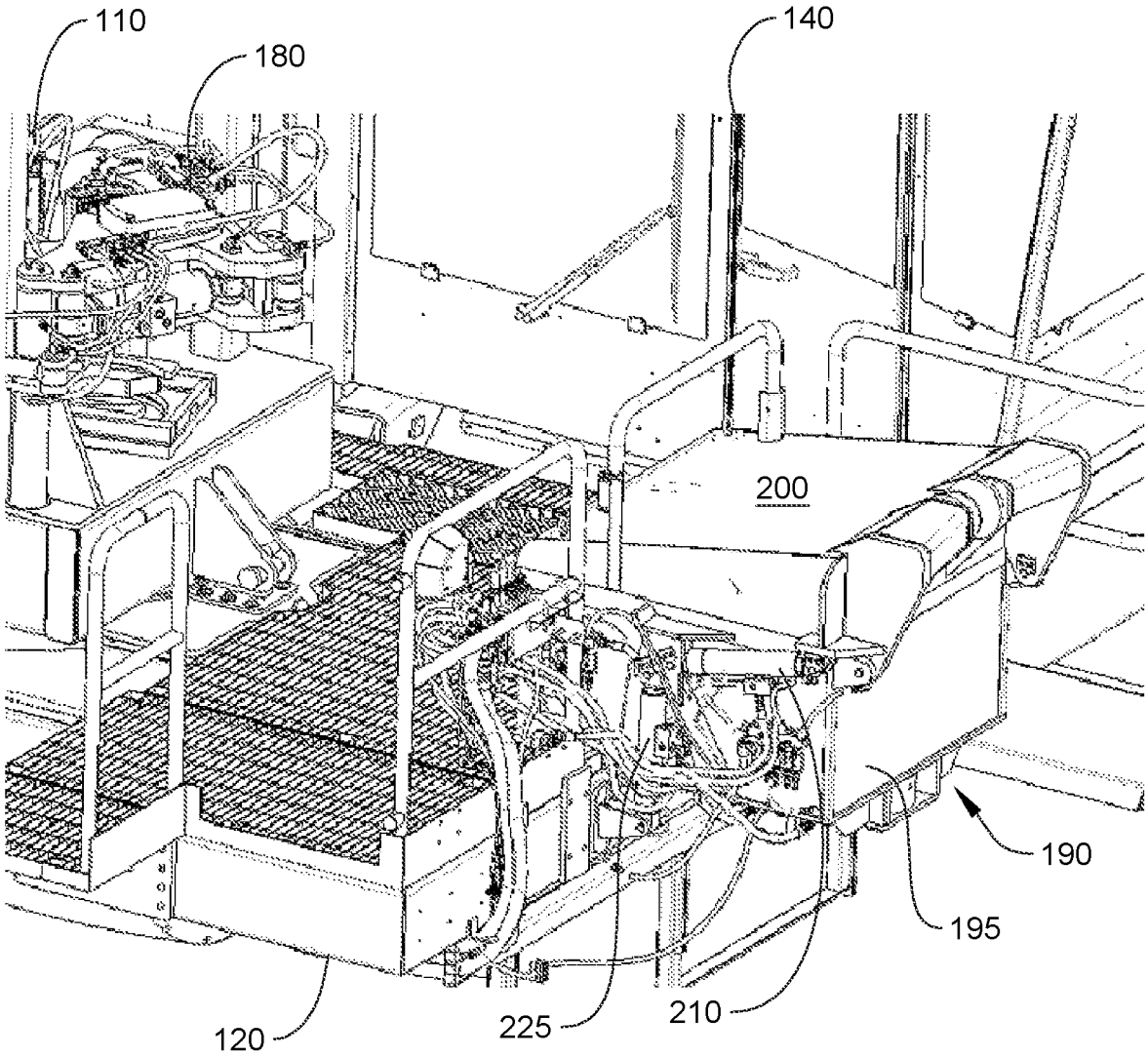
FIG. 3 is a perspective view of the rig platform showing a drilling tool changer assembly positioned near the break-out area of the tower.

FIG. 3 is a perspective view of the rig platform showing the drilling tool changer assembly 190 positioned near the break-out area of the tower. Referring to FIG. 3, we see a drilling tool changer assembly 190, comprising an enclosure 195 for the carousel assembly 230 (see FIGS. 7 and 8). The drilling tool changer assembly 190 is disposed on the rig platform 120 and mounted by a hinge 220 so as to rotate upward from the rear (to the left in FIG. 3) when urged upward by changer actuators 225. FIG. 3 also shows breakout tool 180 adjacent to the base of the tower 110, and the operator's cab 140 that would typically be situated adjacent to tower 110 on the drilling rig 100. The enclosure 195 has a lid 200 that can be opened by action of one or more lid actuators 210, which may be hydraulic or electric motors or the like. The lid 200 is not required, but is desirable to keep dirt and foreign objects from falling into the drilling tool changer assembly 190.

It is advantageous that the disclosed drilling tool changer assembly 190 is not located over the opening in the drill deck 120, where it could interfere with breakout operations, and further, is not located on or connected to the tower 110, where it would add extra weight and complicate balancing the tower 110.

Figure 4:
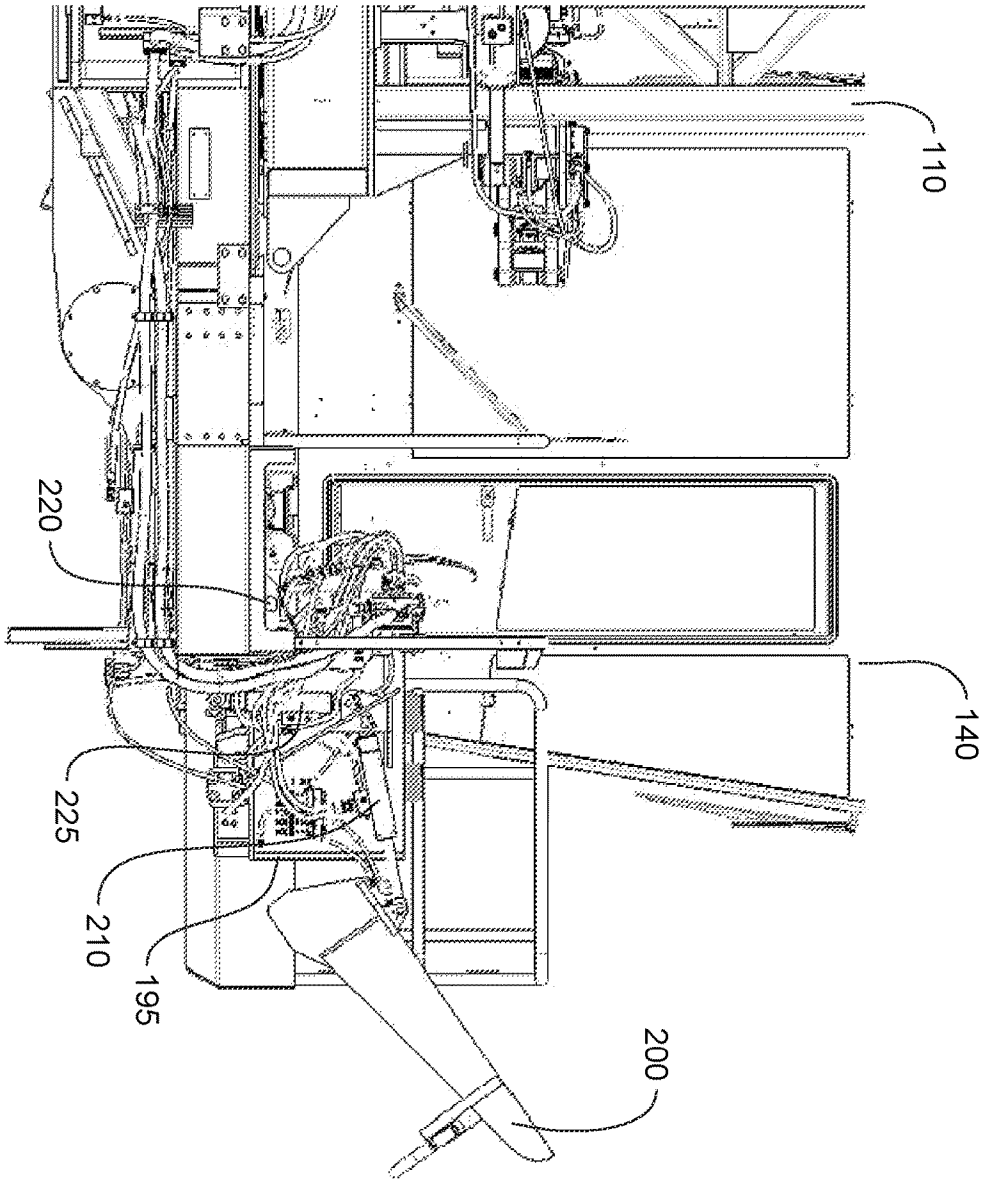
FIG. 4 is a side view of the structure in FIG. 3 showing the lid to the drilling tool changer assembly enclosure opened.
Figure 5:
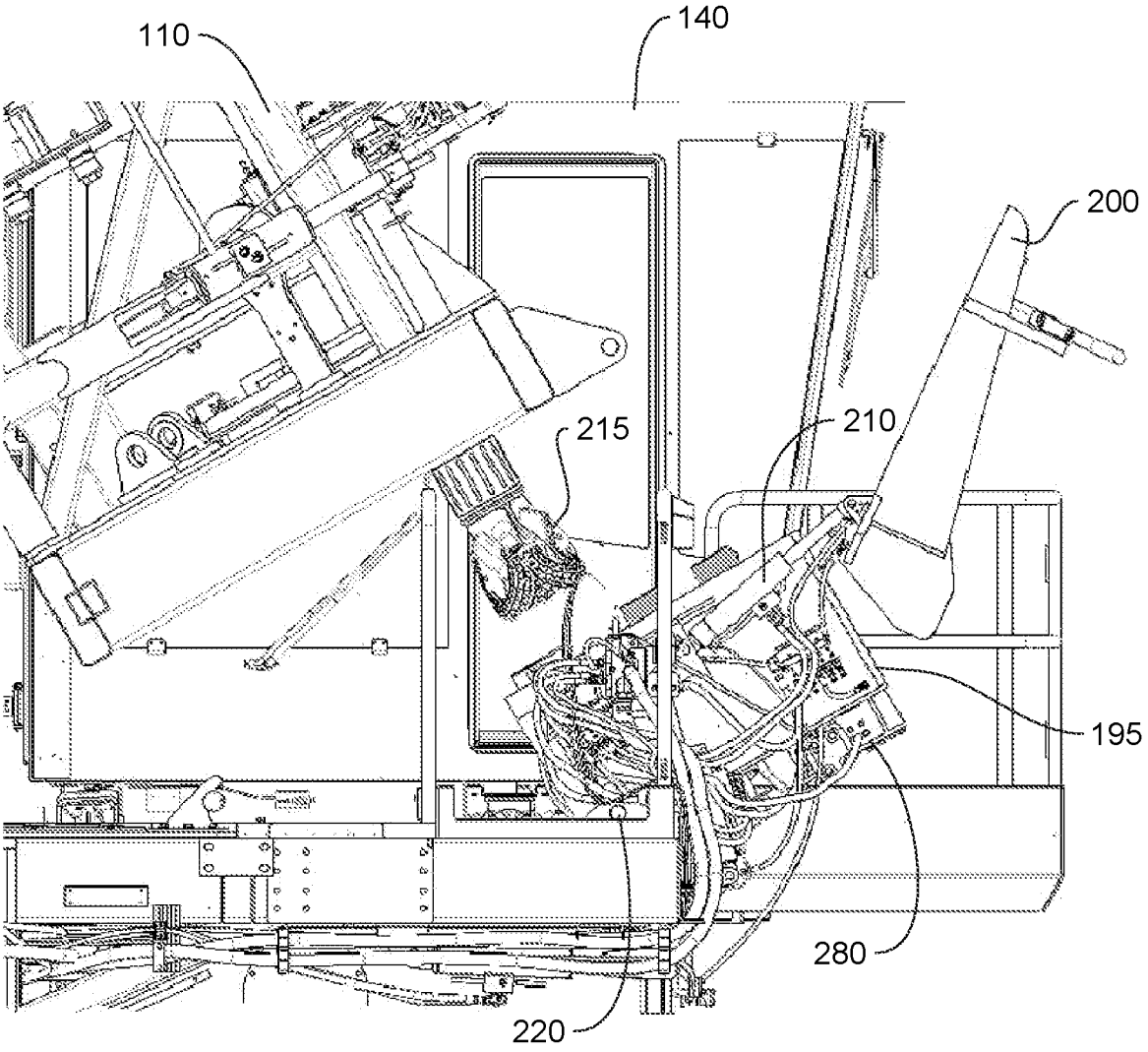
FIG. 5 is a side view of the structure of FIG. 4, showing the drilling tool changer assembly tilted to engage with a drill pipe in the tower; the drill pipe having a drilling tool attached.
Figure 6:
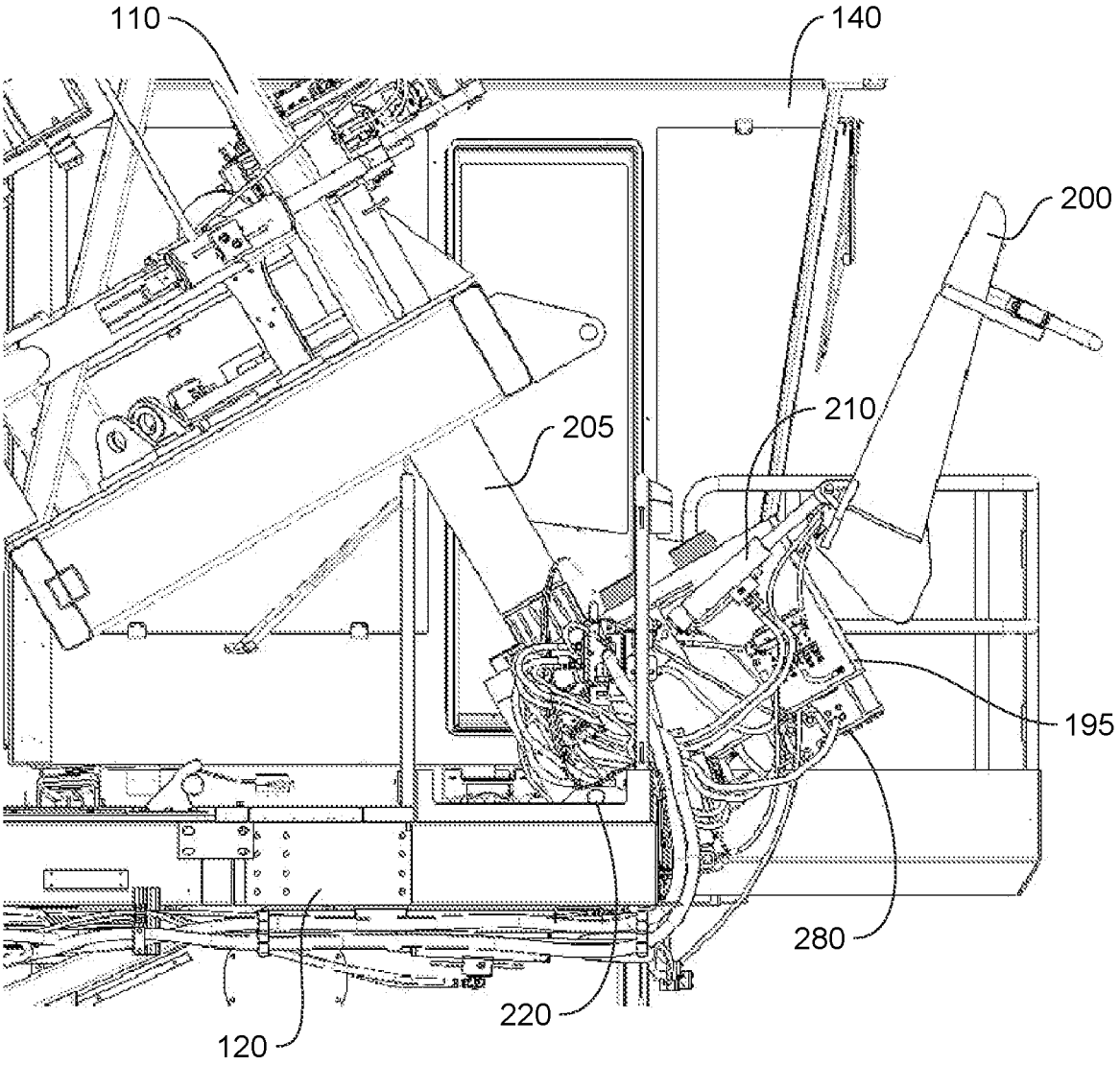
FIG. 6 is a side view of the structure of FIG. 4, showing the drilling tool changer assembly tilted and engaged with a drill pipe for removal or addition of a drilling tool to the drill pipe.
Figure 7:
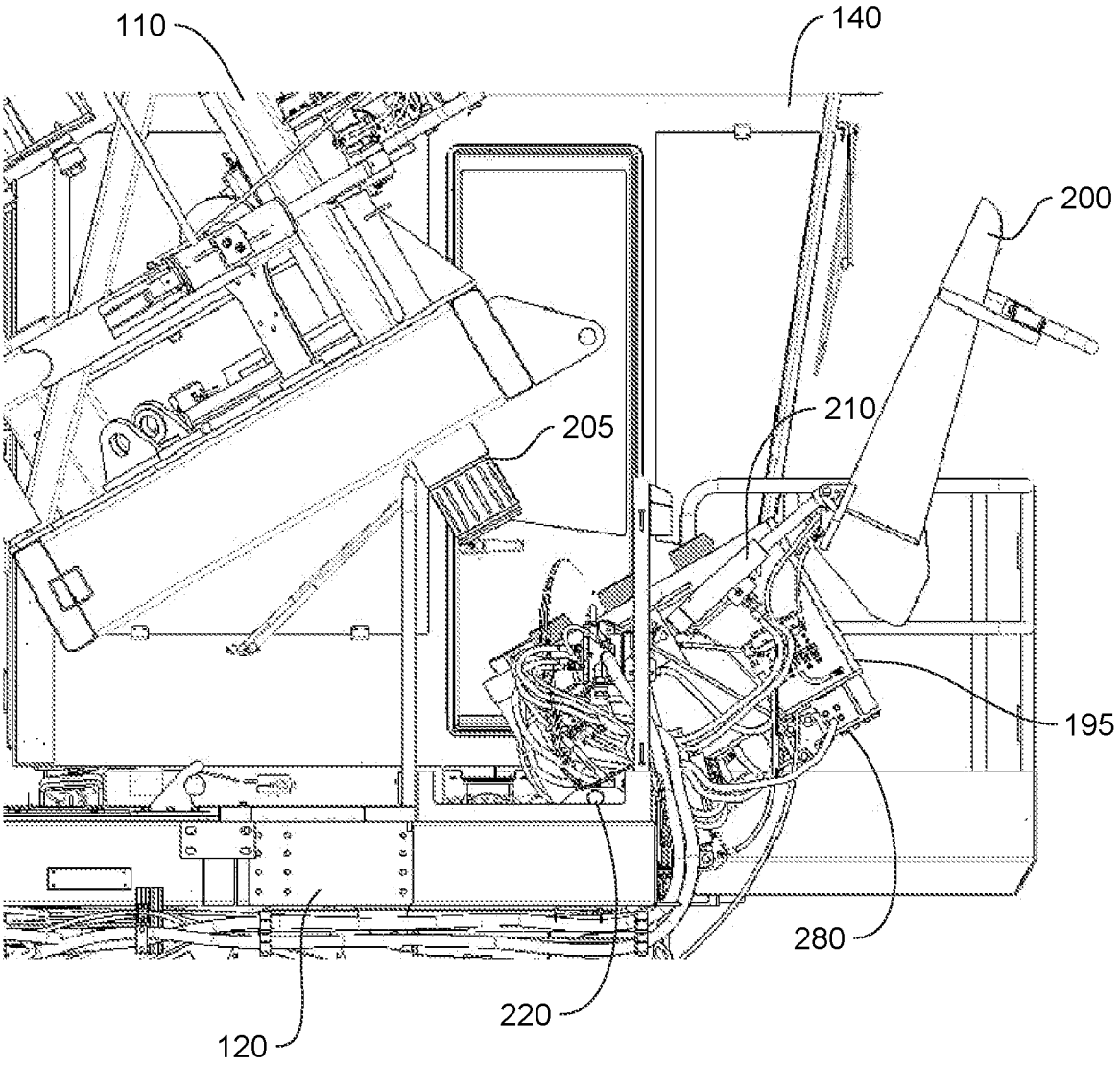
FIG. 7 is a side view of the structure of FIG. 4 showing the drilling tool changer assembly tilted and a drill pipe withdrawn from the assembly after removal of a drilling tool from the drill pipe.

FIG. 4 shows a side view of the structures of FIG. 3, where the lid 200 of the carousel enclosure 195 is opened. In FIG. 5, the drilling tool changer assembly 190, with the lid 200 of the carousel enclosure 195 opened, is tilted forward on the hinge 220 by action of actuators 225, thus moving from a storage position as shown in FIGS. 3 and 4, to an exchange position, as shown in FIGS. 5 and 6. FIG. 6 shows the tilted drilling tool changer assembly 190 receiving a drilling tool 215 from the drill string 150 held by the now-tilted tower 110, where the drilling tool changer assembly 190 is tilted at an angle to substantially match the tilt of the tower 110. FIG. 7 shows a drill string 150 after a drilling tool 215 has been removed and placed in the drilling tool changer assembly 190. FIGS. 5-7 could also illustrate the opposite operation, where a drilling tool 215 is attached to the drill string 150. FIGS. 5-7 show an actuator or motor 280 for rotating the carousel assembly 230. (The actuator or motor 280 may include a gearbox.) The apparatus and procedures for the change-out or replacement of the drilling tool 215 are described in more detail below.

Drilling Tool Changer Carousel Assembly

Figure 8:
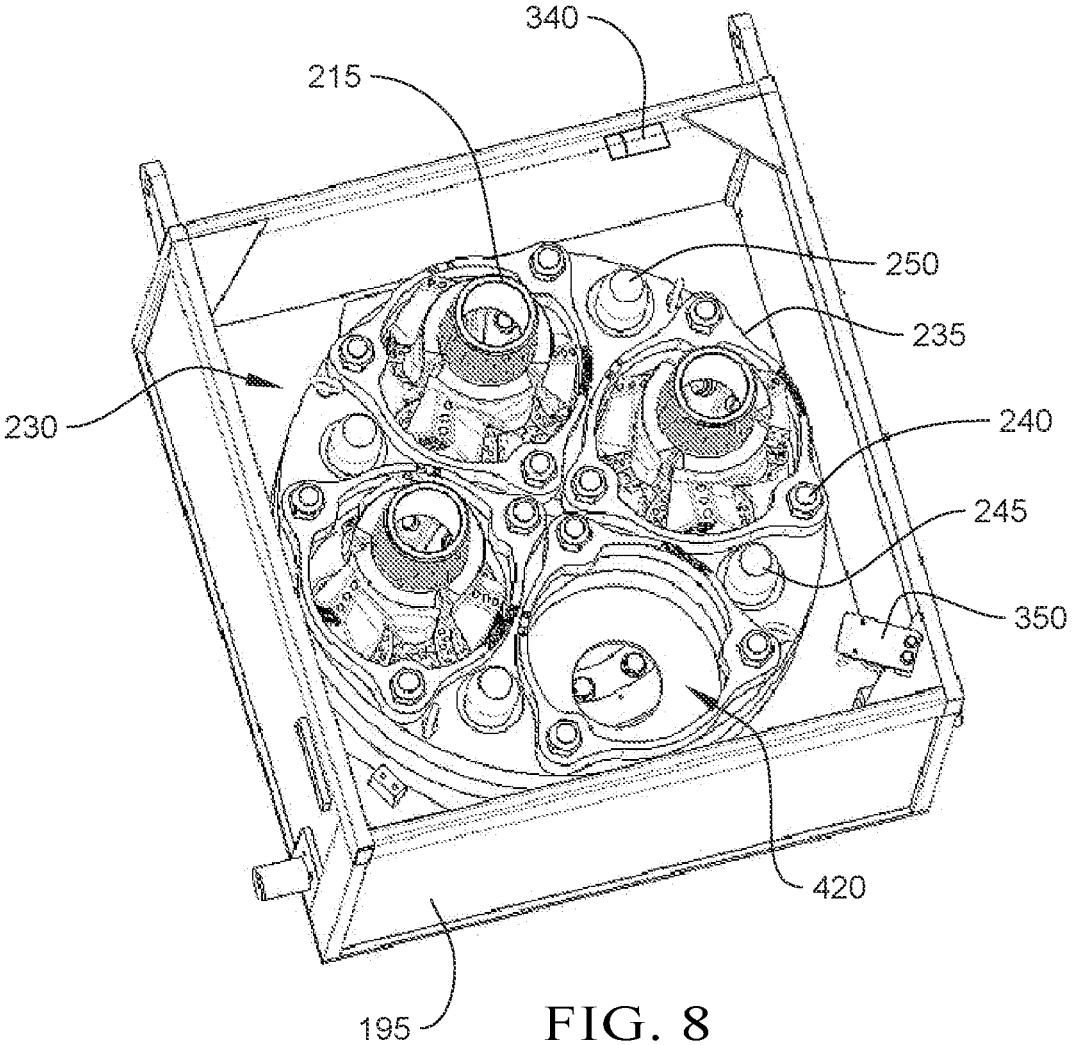
FIG. 8 is a perspective view of the first embodiment of the carousel of a drilling tool changer assembly including an enclosure, with bit adaptors shown holding a plurality of drilling tools.

FIG. 8 is a perspective view of an embodiment of the rotatable carousel assembly 230 of a drilling tool changer assembly 190, situated in an enclosure 195, with bit adaptors 235 shown holding a plurality of drilling tools 215. The rotatable carousel assembly 230 is removable from the drilling tool changer assembly 190 and replaceable therein, as will be described. The rotatable carousel assembly 230 has a plurality of receptacles, called here bit adaptors 235, for receiving drilling tools 215. The rotatable carousel assembly 230 is selectively rotatable, in either direction, via a motor 280, to bring a selected drilling tool 215 into coaxial alignment with the drill string 150 when the drilling tool changer assembly 190 supporting the rotatable carousel assembly 230 is moved into the exchange position as shown in FIGS. 5-7. FIG. 8 also shows an empty bit adaptor 235 in a pre-determined angular position 420 of the rotatable carousel assembly 230, where a used drilling tool 215 may be deposited after removal from the drill string 150. Alternatively, this pre-determined angular position 420 could be the current position of a drilling tool 215 held in the bit adaptor 235, to be attached to the drill string 150. In either case, the rotatable carousel assembly 230 will be rotated to bring the relevant bit adaptor 235 into the correct pre-determined angular position 420 for the pick-up or drop-off of a drilling tool 215 as determined by an operator or the control system 155.

The rotatable carousel assembly 230 has at least one alignment pin 245 situated on the alignment plate 255 below a carousel plate 285, which alignment pin 245 passes through a slot, notch, or hole 290 in the carousel plate 285, so that the carousel plate 285 can be held on the alignment plate 255 in a fixed angular position within the rotatable carousel assembly 230. The carousel plate 285 of this embodiment further comprises at least one off-center alignment hole 295, comprising a slot, notch or hole, mating with an off-center alignment pin 250, for re-aligning the rotatable carousel assembly 230 in the same angular position on the alignment plate 255 after the rotatable carousel assembly 230 is removed from the drilling tool changer assembly 190 and replaced in the drilling tool changer assembly 190. In this way the rig operator, or an automatic process in a control system 155, can know which drilling tool 215 is in which bit adaptor 235 in the rotatable carousel assembly 230. The feature allows the operator or control system 155 to confirm or select the correct drilling tool 215 for the desired drilling task, because in general, drilling tools 215 may be of different sizes, or types, or even have different conditions of wear, and it is highly advantageous to know without manual inspection which drilling tool 215 is in which position in the rotatable carousel assembly 230, so that drilling operations are not delayed after a change-out of drilling tools 215.

The reader should note that the alignment pin or pins 245, and the off-center alignment pin 250 are shown schematically in the figures, and represent, in general, an indexing feature. These may be any sort of finger, rod, or lug that can engage slots, notches or holes in the carousel plate 285 to maintain the same in a given angular position in the rotatable carousel assembly 230, and thus the terms "alignment pin" or "off-center alignment pin" should be construed broadly according to this indexing function. In particular, in some embodiments therefore, alignment pins 245 or off-center alignment pin 250 do not pierce the carousel plate 285 completely in order to engage it.

In some embodiments, the rotatable carousel assembly 230 may optionally be a first rotatable carousel assembly 230, and the rotatable carousel assembly 230 replaced in the drilling tool changer assembly 190 may be a second rotatable carousel assembly 230, the second rotatable carousel 230 having possibly replaced or exchanged drilling tools 215.

Figure 9A:
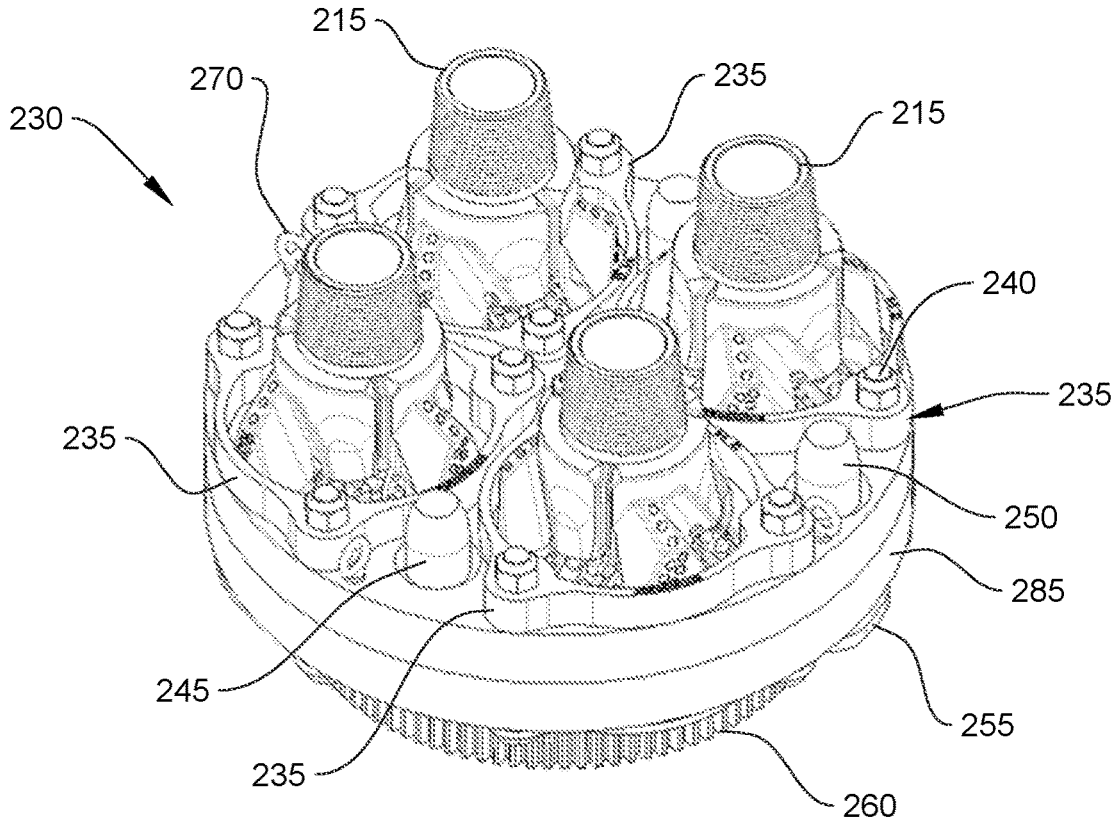
FIG. 9A is the assembled carousel shown holding drill bits.

FIG. 9A shows examples of drilling tools 215 resting in the bit adaptors 235. Each bit adaptor 235 is connected to a carousel plate 285. FIG. 9A shows alignment holes 290 in the carousel plate 285 for selectively receiving an alignment pin 245, and also shows at least one off-center alignment hole 295 and off-center alignment pin 250, to allow indexing of the carousel plate 285. The carousel plate 285 may be a single plate, or constructed of two plates bolted together by bolts or retaining pins 240, for ease of manufacturing.

FIG. 9A shows the rotatable carousel assembly 230 as described in above, but including the alignment plate 255 that supports the alignment pins 245 and off-center alignment pin or pins 250. (Generally, only one off-center pin 250 would be required for alignment, but more than one could be provided, and reference here to an "alignment pin" includes one or more.) The carousel plate 285 and the bit adaptors 235 are preferably bolted together with bolts 240. FIG. 9A shows the alignment plate 255 supporting the alignment pins 245 and off-center alignment pin 250, rotatable by a bull gear 260. As shown in FIG. 9, the carousel plate 285 is removably supported by the alignment plate 255, and the alignment pins 245 and off-center alignment pin 250 thus pass through holes or slots 290 in the carousel plate 285. One of the holes or slots is an off-center alignment hole 295, so that the carousel plate 285 (and thus the bit adaptors 235) can only be indexed to and replaced in one position on the alignment plate 255.

Figure 9B:
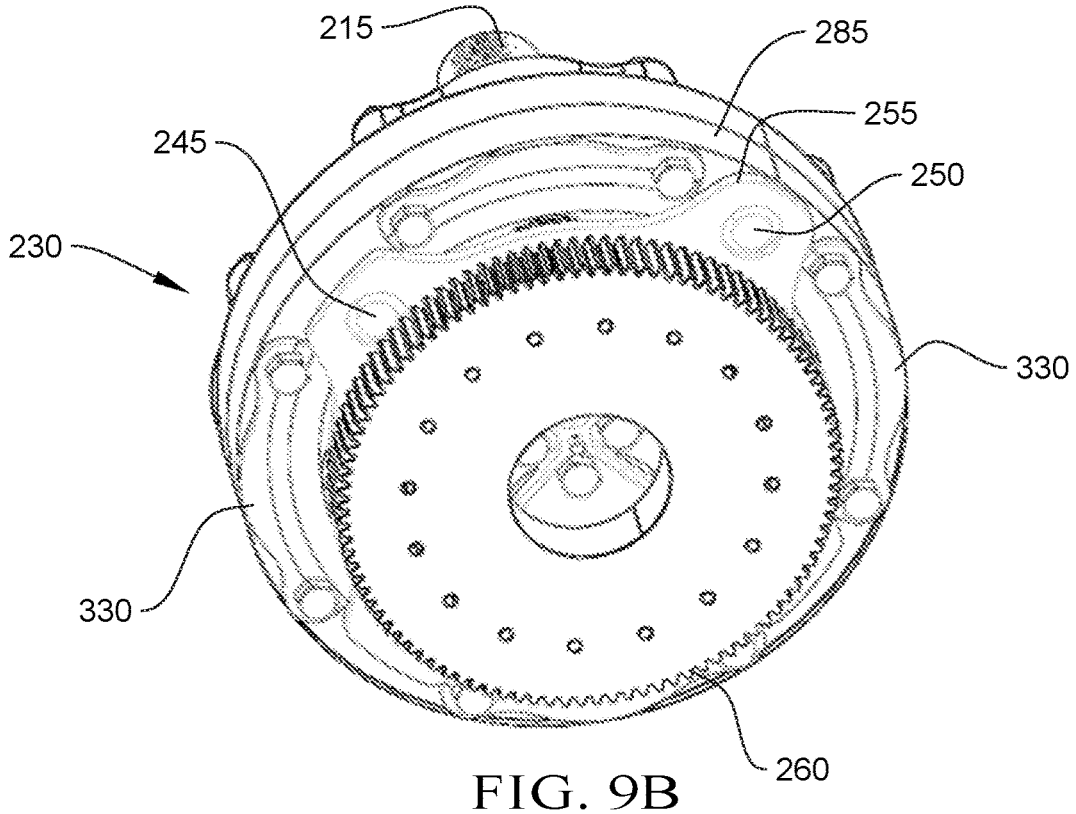
FIG. 9B is a perspective view of an embodiment of the rotatable carousel assembly viewed from the rear.

FIG. 9B is a perspective view of this embodiment of the rotatable carousel assembly 230 viewed from the rear or bottom of the assembly depicted in FIG. 9A. FIG. 9B shows how the carousel plate 285 is supported on the alignment plate 255, and how the alignment plate 255 is fastened to a bull gear 260, which bull gear 260 rotates the alignment plate 255, and thus the carousel plate 285, when rotation is imparted to the bull gear 260 by an actuator, such as a motor 280 and pinion gear (not shown in FIG. 9). The rotation imparted may be in either direction, under command of an operator or an automatic process in a control system 155, to index the rotatable carousel assembly 230 to the desired position, as explained below.

Figure 10A:
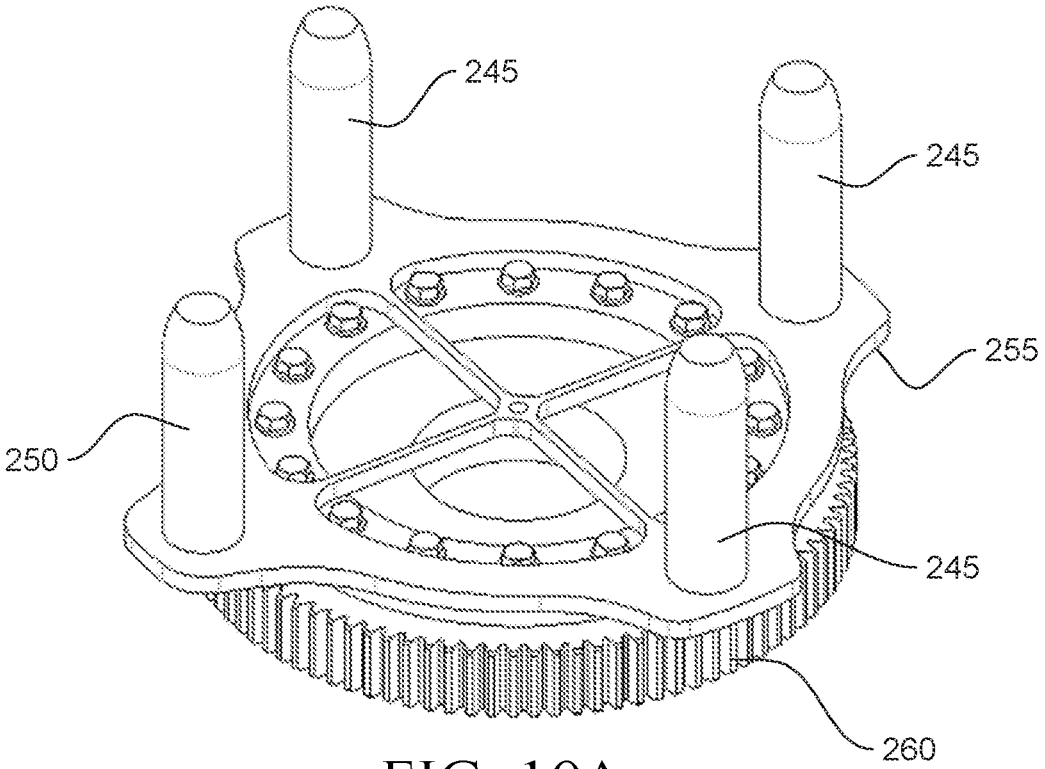
FIG. 10A is a perspective view of the alignment plate of the rotatable carousel of the drilling tool changer assembly, showing alignment pin to be received by the carousel plate.
Figure 10B:
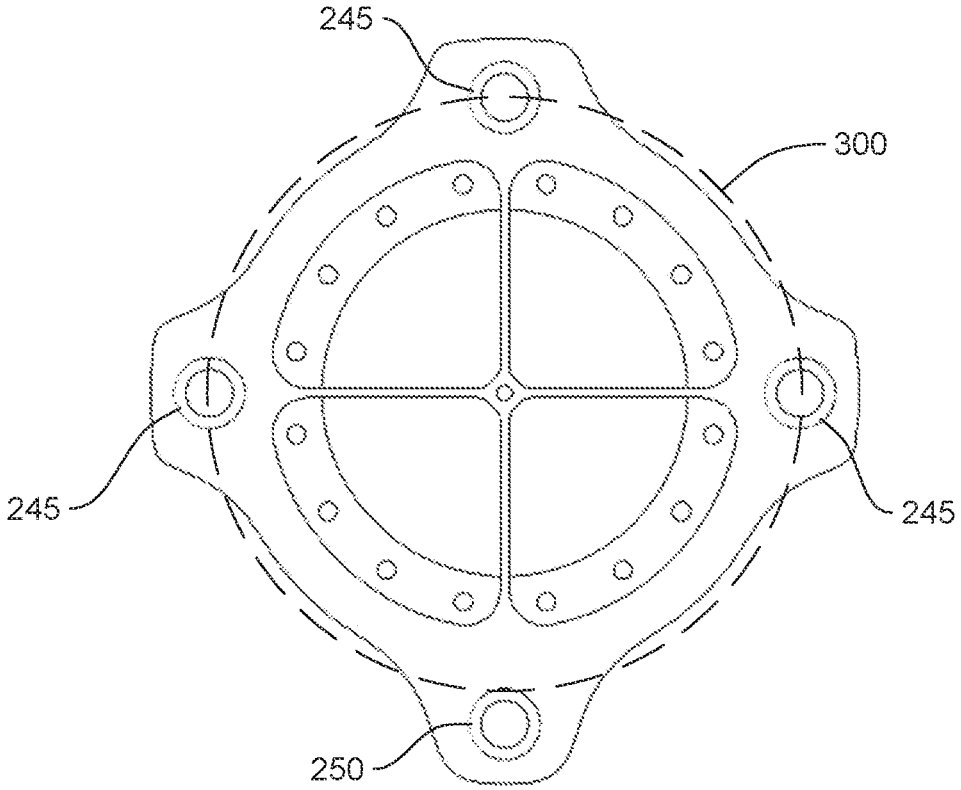
FIG. 10B is a plan view of the structure of FIG. 10A, showing the off-center location of one alignment pin.

FIG. 10A show a perspective view of the alignment plate 255 supported by the bull gear 260. The alignment plate 255 supports a plurality of alignment pins 245, and at least one off-center alignment pin 250. As described above with reference to FIG. 9, the carousel plate 285 is supported by the alignment plate 255, where alignment holes 290 (and off-center alignment hole 295) in the carousel plate 285 receive, respectively, alignment pins 245 and the at-least one off-center alignment pin 250. This structure is shown in plan view in FIG. 10B, where the circumference 300 of a circle on the radius of the alignment pins 245 is shown, illustrating the off-center location of the at least one off-center alignment pin 250, as well as the respective alignment holes 290 and off-center hole 295 in the carousel plate.

Figure 11:
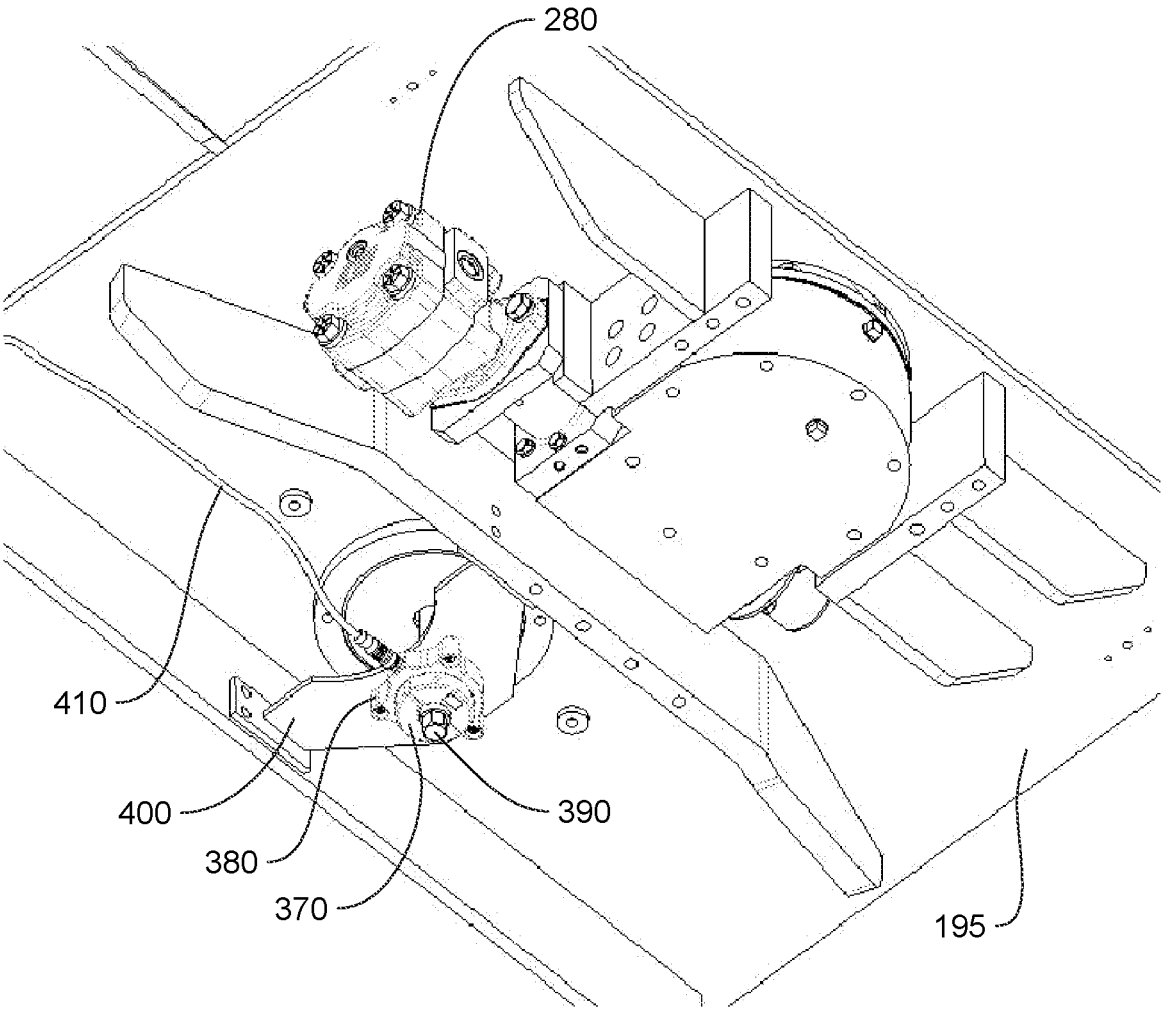
FIG. 11 is a perspective view of an embodiment of the drilling tool changer assembly, viewed from the underside of its enclosure and illustrating a sensor arrangement for detecting the angular position of the rotatable carousel.

FIG. 11 illustrates an embodiment of a sensor arrangement for detecting the angular position of the rotatable carousel assembly 230. A magnet 370 or equivalent is connected to a pin or shaft 390, which pin or shaft 390 is connected to the alignment plate 255 and compelled to rotate therewith. A sensor 380 detecting the position of the magnet 370 is fixed to a bracket 400 or other convenient structure that is fixed to the enclosure 195 of the drilling tool changer assembly 190, so that as the alignment plate 255 rotates by action of the motor 280, the change in output from the sensor 380 corresponds to the angular position of the alignment plate 255, and thus the angular position of the rotatable carousel assembly 230, which is rotated by action of the alignment plate 255. Because the rotatable carousel assembly 230 only fits the alignment plate 255 in one pre-determined position, the output of the sensor 380 uniquely reports the angular position of the rotatable carousel assembly 230, which output is preferably communicated to the control system 155 by means of a connector 410, which can be a cable or wireless connection. A suitable magnetic sensor of this type would be the SMART Position Sensor configuration, manufactured by Honeywell International, Inc., or equivalent.

Figure 12A:
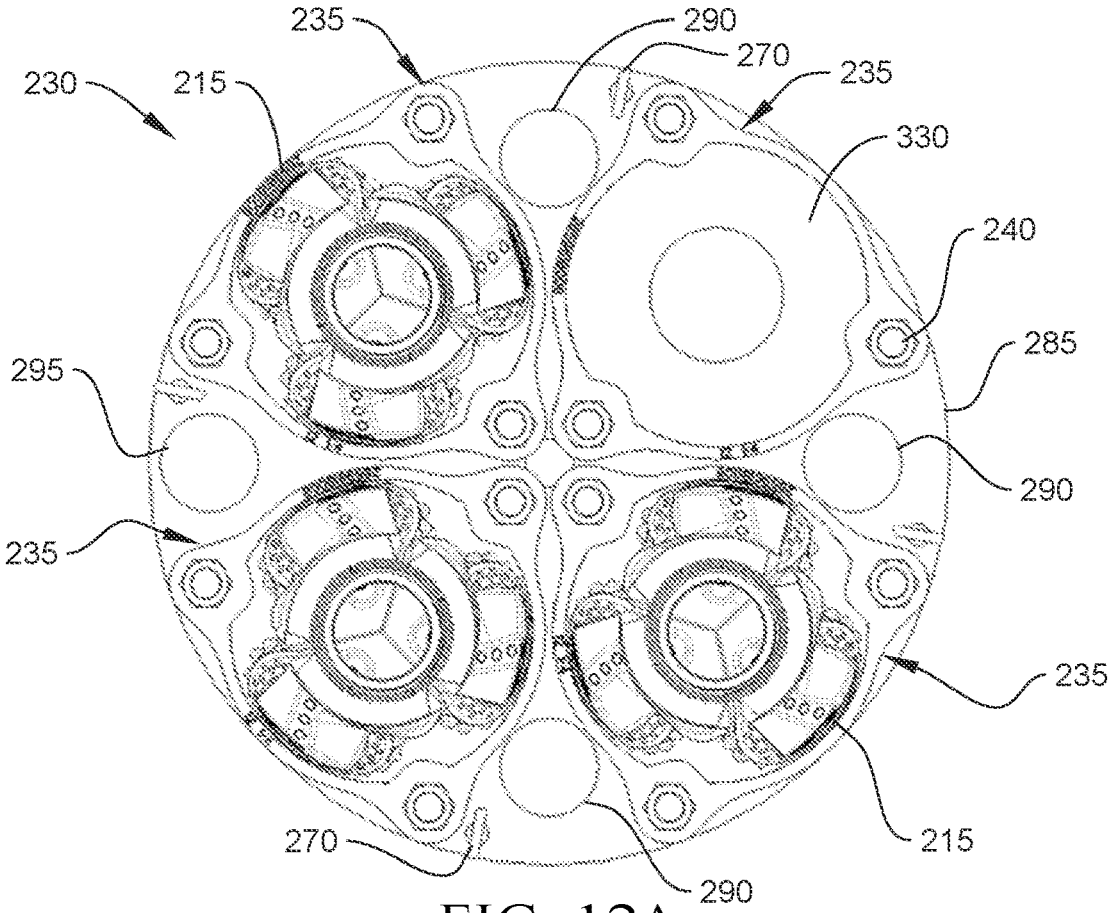
FIG. 12A is a plan view of the rotatable carousel of the drilling tool changer assembly.
Figure 12B:
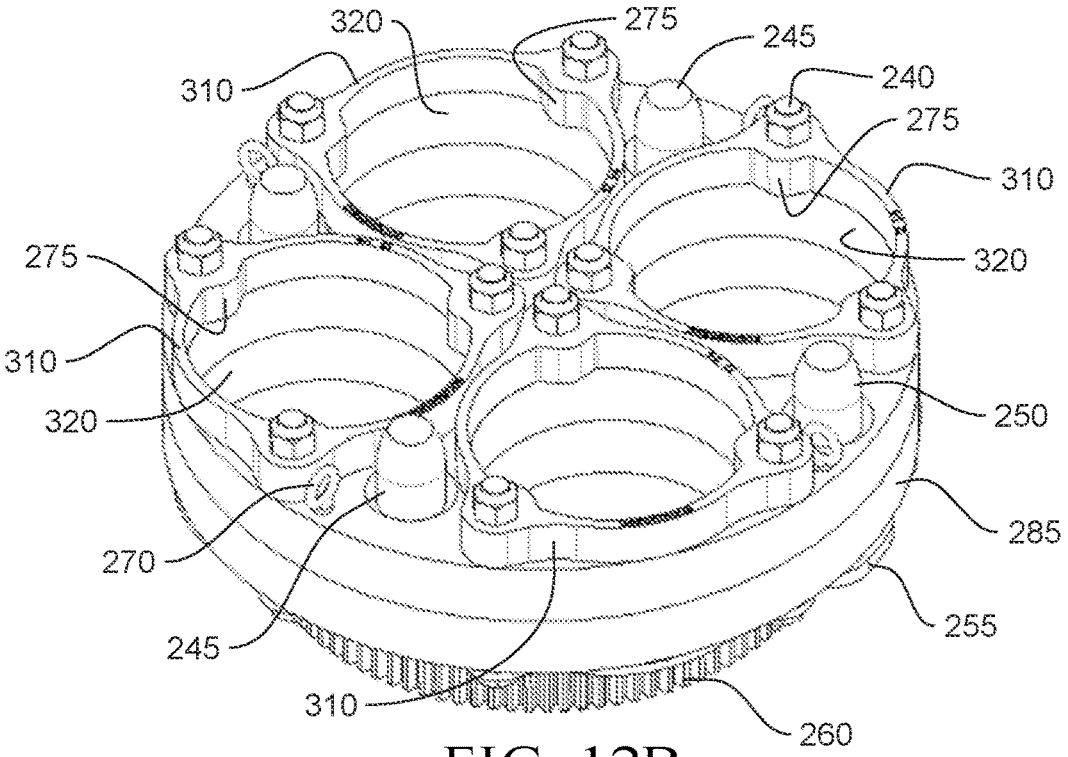
FIG. 12B is a perspective view of the carousel without drilling tools in the holders for the same.

FIG. 12 is a more detailed view of the carousel assembly 230 of the drilling tool changer assembly 190, FIG. 12A being a plan view and FIG. 12B being a perspective view of the same. In FIG. 12A, three bit adaptors 235 are occupied by drilling tools 215, and one bit adaptor 235 is empty. (The reader should note that the number of bit adaptors 235 in a carousel assembly may be more or fewer than the four shown.) In FIG. 12B, for clarity, all the bit adaptors 235 are shown as empty.

FIGS. 12A and 12B show a carousel plate 285, which may be one integral plate, or, for convenience of construction, two or more plates fastened together, with bolts, such as the retaining pins or bolts 240 shown. The carousel plate 285 supports bit adaptors 235 (described in more detail below), for receiving drilling tools 215. The carousel plate 285 has holes 290 for receiving alignment pins 245, and at least one off-center hole 295 for receiving an at least one off-center alignment pin 250. In this way, a particular type of drilling tool 215 located in a particular bit adaptor 235, and be replaced in the same position in the carousel assembly 230, if the carousel assembly 230 is removed and replaced in the drilling tool changer assembly 190.

Further referring to FIGS. 12A and 12B, the figures show lifting rings 270, where by a lifting apparatus, such as a crane, can attach to and lift out the carousel assembly 230 for replacement of drilling tools 215 in the bit adaptors 235. The bit adaptors 235 are shown fastened to the carousel plate 285 by retaining pins or bolts 240. As illustrated below, each bit adaptor 235 further comprises a breaker plate 310 and a bit holder 320. Alternatively, the breaker plate 310 may be fastened to a bit holder plate 330 that may be removable. The breaker plate 310 of the bit adaptors 235 comprises nubs 275 in its inner circumference to hold the drilling tool 215 and resist the torque of the drill pipe 205 when the drill pipe 205 is rotated by the break-out tool mechanism 180, as a drilling tool 215 is added to or removed from the drill pipe 205. Therefore, no special sub or supplemental adaptor to the drilling tool 215 is required for the breakout operations.

Figure 13A:
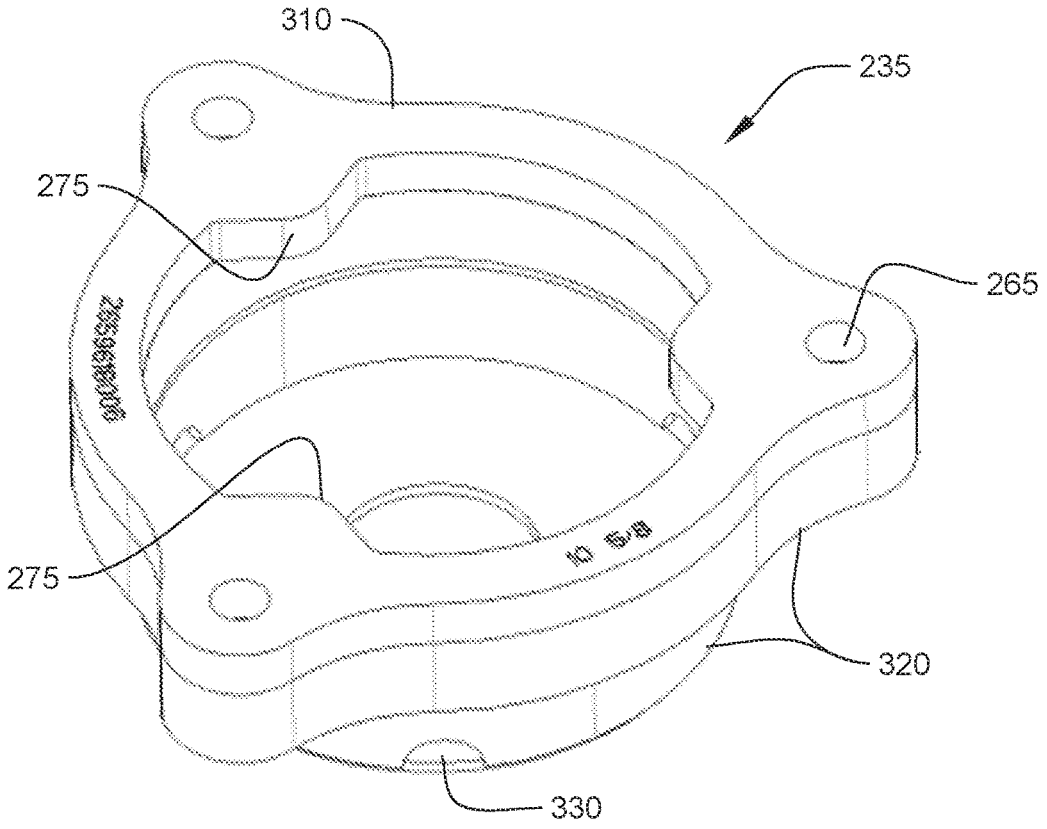
FIG. 13A is an adaptor having a welded bottom plate and FIG. 13B is an adaptor having a removable bottom plate.
Figure 13B:
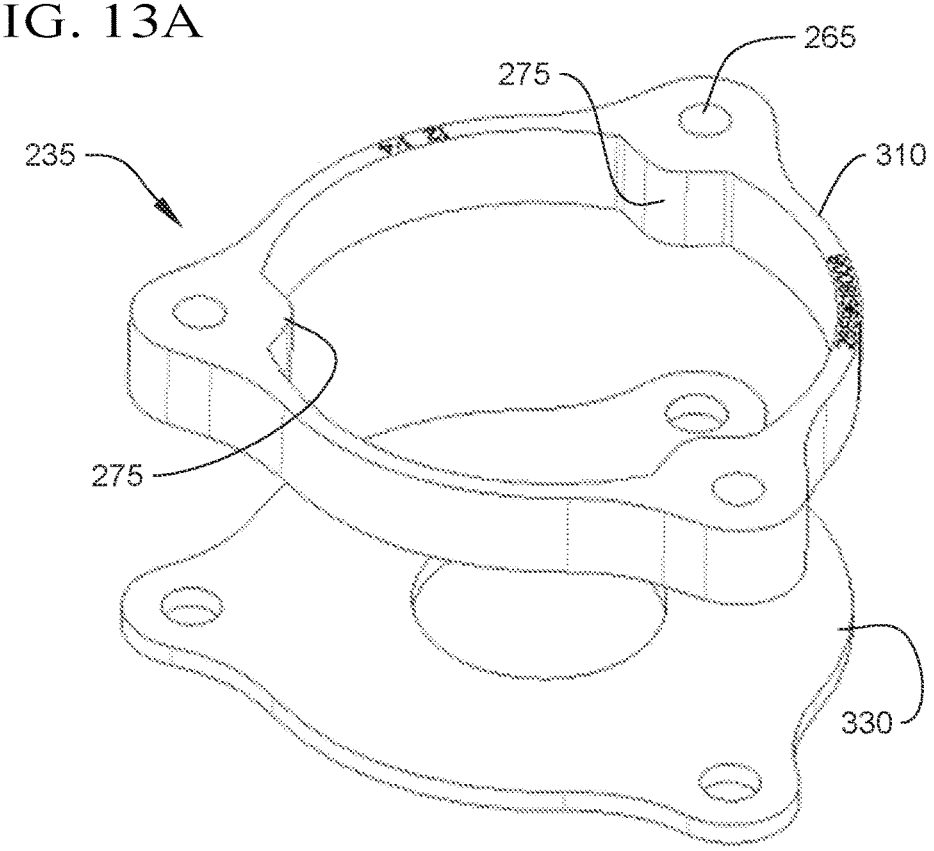

FIG. 13 shows more detail of bit adaptor 235 of the drilling tool changer assembly 190. In FIG. 13A, an embodiment has a breaker plate 310 with nubs 275, where the nubs 275 are sized to grasp a drilling tool 215 of a pre-determined size and restrain its movement against the torque of the break-out operation. In FIG. 13A, the bit holder 320 and the bit holder plate 330 are alternatively welded together to form an integral unit. Mounting holes 265 are provided for mounting the bit adaptor 235 to the carousel plate 285. In the embodiment of FIG. 13B, the breaker plate 310 is connected to a bit holder plate 330, where the bit holder plate 330 supports a drilling tool inserted into the bit adaptor 235. The embodiment of FIG. 13A, providing a more shallow receptacle, is adapted to support and hold smaller drilling tools 215 than the embodiment of FIG. 13B. In either embodiment, the bit adaptor functions to provide storage for the drilling tool 215 in the carousel assembly 230, while also holding the drilling tool 215 firmly against the torque of the break-out operation.

Figure 14A:
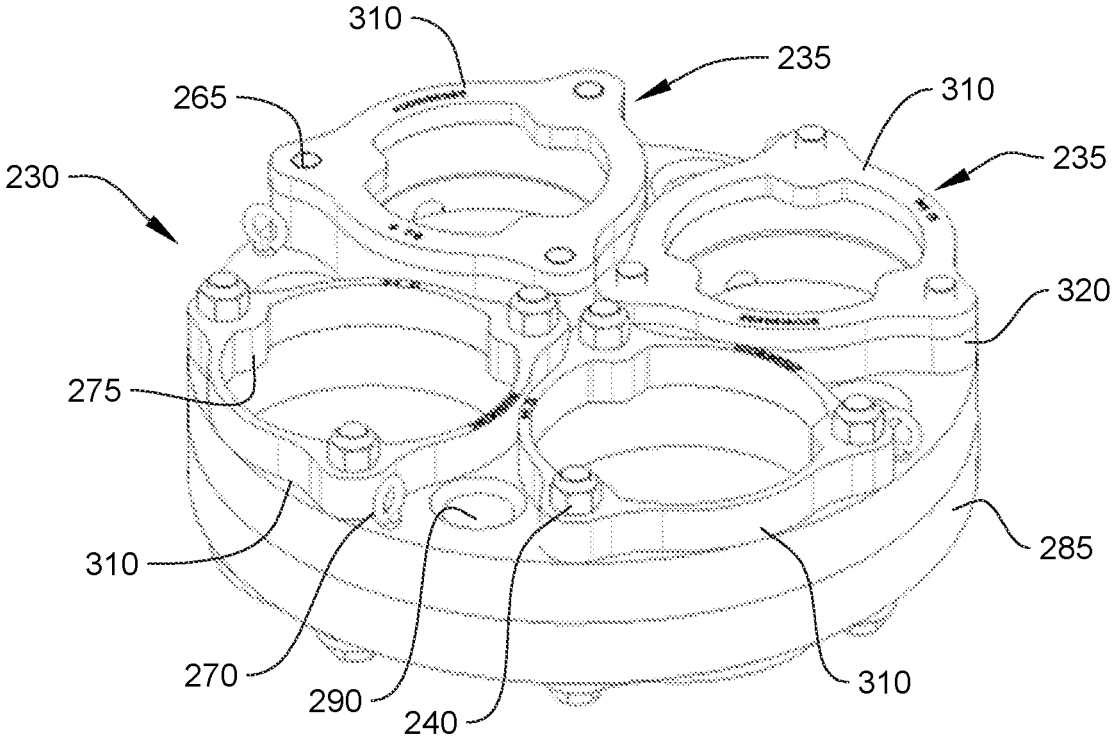
FIG. 14A shows empty bit holders on the carousel of the drilling tool changer assembly.
Figure 14B:
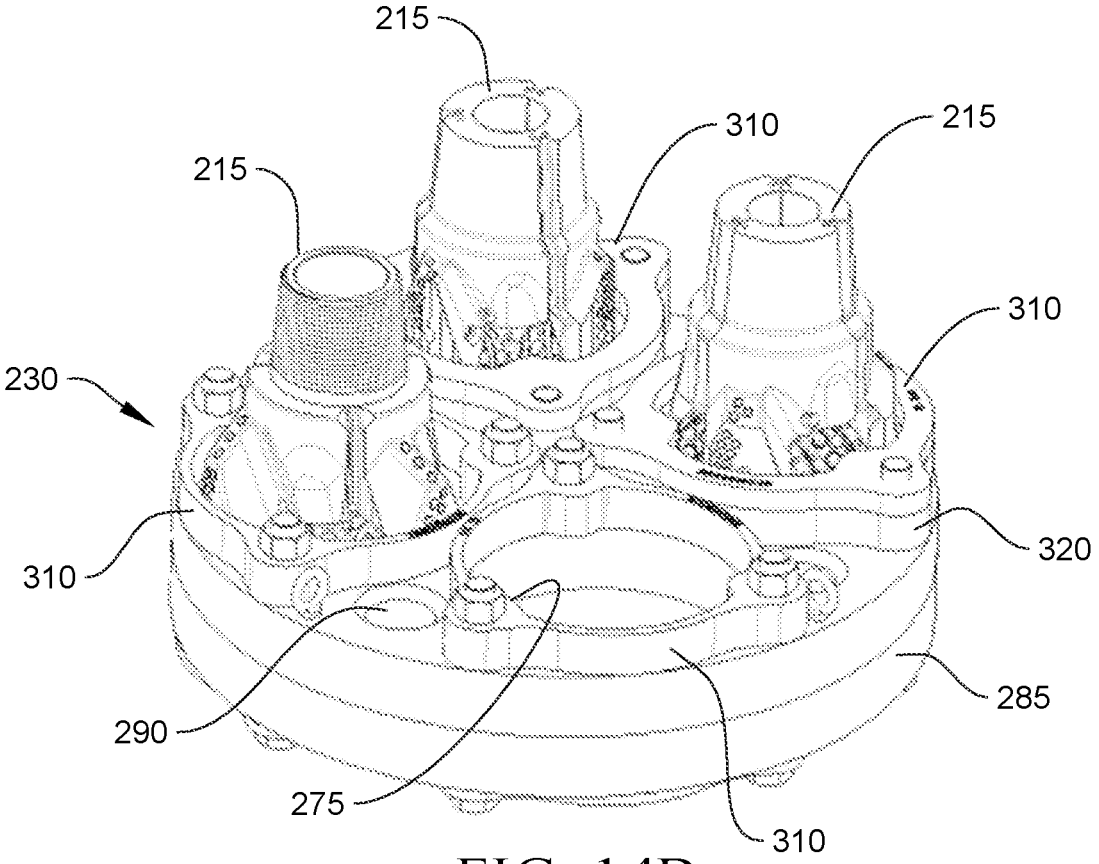
FIG. 14B shows a plurality of bits or drilling tools disposed in bit adaptors of possibly varying sizes on a carousel plate.
Figure 15A:
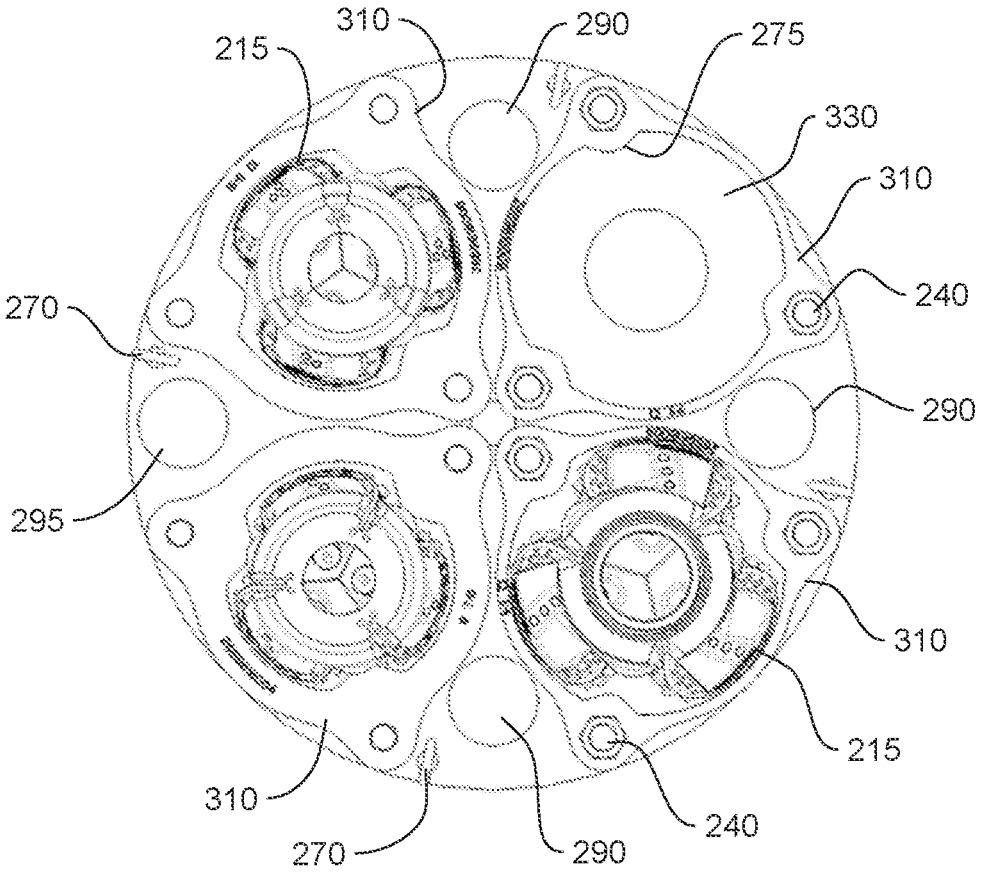
FIG. 15A is a plan view of the embodiment of the drilling tool changer assembly where the bit adaptors are of various sizes.
Figure 15B:
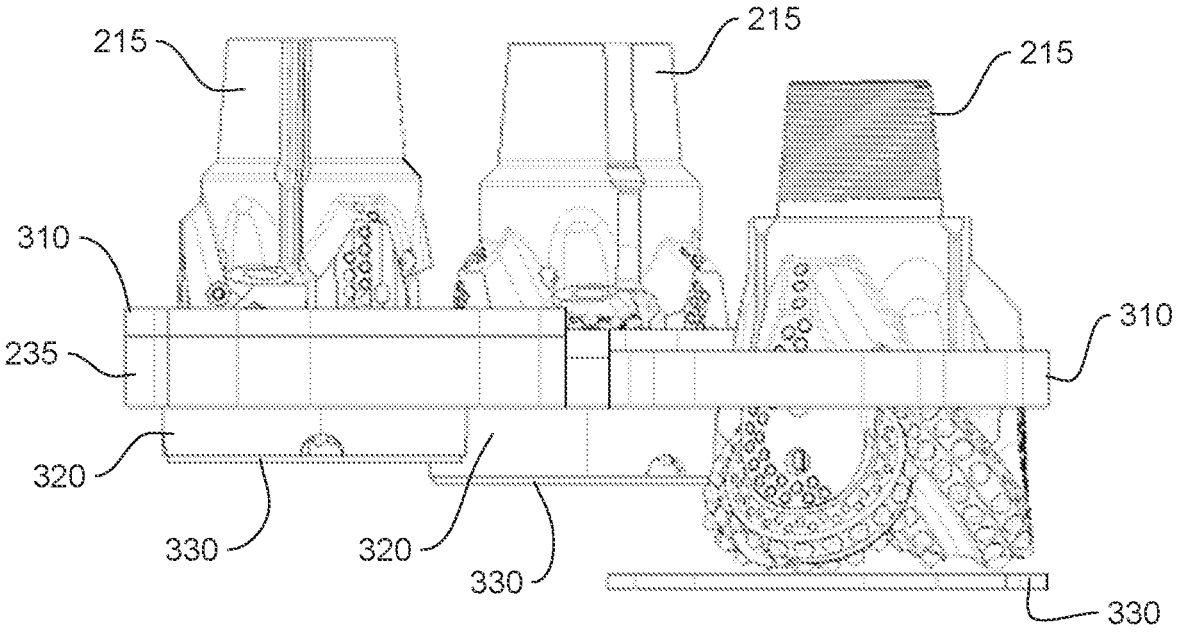
FIG. 15B is a side cut-away view of bit adaptors of various sizes on a carousel.

FIGS. 14A and 14B show embodiments of the drilling tool changer assembly 190 where the bit adaptors 235 situated in the carousel assembly 230 are sized to receive drilling tools 215 of differing sizes, both in diameter or in depth, or both dimensions. FIG. 15A is a plan view of such an embodiment. FIG. 15B is a side view omitting depiction of the carousel plate 285 for clarity, and showing only the exemplary bit adaptors 235 of varying sizes. In FIG. 15B, the rightmost bit adaptor 235 depicted has a bit holder plate 330, but alternatively lacks a bit holder 320.

Detection of Drilling Tools in Changer Assembly

It is advantageous for an operator or an automatic process to detect if a bit or drilling tool 215 is present in the rotatable carousel assembly 230, so that no attempt will be made to engage with the drill pipe 205 if no bit is present. Also, it is advantageous that an operator or automatic process can detect which type of bit or drilling tool 215 is actually present in a particular bit adaptor 235. To that end, embodiments can be provided with these capabilities. Radio-frequency identification (RFID) technology, for example, is known in the art. FIG. 8 illustrates an RFID sensor 340 situated at some convenient location in the enclosure 195 of the rotatable carousel assembly 230. The RFID sensor 340 can read a corresponding RFID tag (not shown) on a drilling tool 215 and transmit this identification to an operator or automatic process in the control system 155, where it may be stored for further reference or use in the automatic process. For example, an automatic process could select the desired size and type of drilling tool 215 for particular rock strata or drilling conditions. Equivalently, electromagnetic sensors could be employed, such as near-field communications devices operating on principles generally within RFID technology, as is known in the art. In other embodiments, the RFID sensor 340 could be a plurality of RFID sensors 340, where each is associated with a particular bit adapter 235.

Further, FIG. 8 shows an ultrasonic detector 350, which provides the capability of detecting whether or not a drilling tool 215 is present in a particular bit adaptor 235 of the rotatable carousel assembly 230. In the case of both the RFID sensor 340 and the ultrasonic detector 350, the relevant index or angular position of the rotatable carousel assembly 230 (as known by the means described in connection with FIG. 11 above) can be correlated with the identification returned from the RFID sensor 340, or with the signal from the ultrasonic detector 350 to provide this information to an operator or to an automatic process in the control system 155, where it may be stored for future reference or use in an automatic process. Equivalents in other embodiments could be a radar sensor to detect presence of a bit 215, or a switch.

None of the description in this application should be read as implying that any particular element, step, or function is an essential element which must be included in the claim scope; the scope of patented subject matter is defined only by the allowed claims. Moreover, none of these claims are intended to invoke 35 U.S.C. Section 112(f) unless the exact words "means for" are used, followed by a gerund. The claims as filed are intended to be as comprehensive as possible, and no subject matter is intentionally relinquished, dedicated, or abandoned.

The invention claimed is:

1. An apparatus for changing a drilling tool for a drilling rig, where the drilling rig comprises a drill tower supporting a drill pipe;

the apparatus for changing a drilling tool comprising:

a drilling tool changer assembly moveable between a storage position and an exchange position;

the drilling tool changer assembly supporting a rotatable carousel assembly;

the rotatable carousel assembly capable of removal from the drilling tool changer assembly and capable of replacement on the drilling tool changer assembly in a same angular position;

the rotatable carousel assembly having a plurality of bit adaptors for holding drilling tools; and the rotatable carousel assembly selectively rotatable to bring a selected drilling tool into coaxial alignment with the drill pipe when the drilling tool changer assembly supporting the rotatable carousel assembly is moved into the exchange position;

wherein the drilling tool changer assembly further comprises a detector for detecting the presence or absence of a drilling tool in a bit adaptor of the plurality of bit adaptors that is in a predetermined angular position for pick-up or drop-off of a drilling tool in the rotatable carousel assembly.

2. The apparatus for changing a drilling tool of claim 1, where the rotatable carousel assembly is further selectively rotatable to bring a selected bit adaptor of the plurality of bit adaptors into the pre-determined angular position for pick-up or drop-off of a drilling tool in the rotatable carousel assembly.

3. The apparatus for changing a drilling tool of claim 1, where the rotatable carousel assembly removed from the drilling tool changer assembly is a first rotatable carousel assembly, and the rotatable carousel assembly replaced in the drilling tool changer assembly is a second rotatable carousel assembly.

4. The apparatus for changing a drilling tool of claim 1, where the bit adaptors further comprise at least one nub for holding a drilling tool against a torque imparted to the drilling tool.

5. The apparatus for changing a drilling tool of claim 1, where the drilling tool changer assembly further comprises at least one indexing feature for re-aligning the rotatable carousal assembly in the same angular position after the rotatable carousel assembly is removed from the drilling tool changer assembly and replaced in the drilling tool changer assembly.

6. The apparatus for changing a drilling tool of claim 5, where the at least one indexing feature comprises at least one alignment pin.

7. The apparatus for changing a drilling tool of claim 6, further comprising a plurality of alignment pins, where at least one of the alignment pins is an off-center alignment pin for indexing the rotatable carousel to the same angular position.

8. The apparatus for changing a drilling tool of claim 6, further comprising an alignment plate; where the at least one alignment pin is connected to the alignment plate.

9. The apparatus for changing a drilling tool of claim 8, further comprising a carousel plate; the carousel plate removably supported by the alignment plate.

10. The apparatus for changing a drilling tool of claim 8, further comprising a bull gear and a pinion; where the alignment plate is connected to the bull gear; the bull gear engaging the pinion for rotating the bull gear and the alignment plate therewith.

11. The apparatus for changing a drilling tool of claim 9, where the carousel plate engages the at least one alignment pin to align the rotatable carousel assembly in the same angular position.

12. The apparatus for changing a drilling tool of claim 1, where the drilling tool changer assembly is pivotably hinged to bring the rotatable carousel assembly into coaxial alignment with a drill pipe supported by the drill tower.

13. The apparatus for changing a drilling tool of claim 1, where the bit adaptors are differently sized to accommodate differently-sized drilling tools.

14. The apparatus for changing a drilling tool of claim 1, further comprising a control system for controlling operations of the drilling tool changer assembly.

15. The apparatus for changing a drilling tool of claim 14, further comprising a first actuator for selectively rotating the rotatable carousel assembly under command of the control system.

16. The apparatus for changing a drilling tool of claim 15, further comprising a second actuator for selectively moving the drilling tool changer assembly between the storage position and the exchange position under command of the control system.

17. The apparatus for changing a drilling tool of claim 1, where the drilling tool changer assembly further comprises a sensor for identifying the one or more drilling tools located in the bit adaptors.

18. The apparatus for changing a drilling tool of claim 1, where the drilling tool changer assembly further comprises a sensor for detecting the angular position of the rotatable carousel assembly.

19. The apparatus for changing a drilling tool of claim 16, where the drilling tool changer assembly further comprises an enclosure; the enclosure enclosing the rotatable carousel assembly.

20. The apparatus for changing a drilling tool of claim 19, where the drilling tool changer assembly further comprises a lid and a third actuator; the lid covering the enclosure; and, wherein the lid is deployed between an open position and a closed position by action of the third actuator.

* * * * *